United States Patent [19]

Cescon et al.

[11] Patent Number: 4,555,278

[45] Date of Patent: Nov. 26, 1985

[54] STABLE NITRATE/EMULSION EXPLOSIVES AND EMULSION FOR USE THEREIN

[75] Inventors: Lawrence A. Cescon, Hagerstown, Md.; Nolan J. Millet, Jr., Hopatcong, N.J.

[73] Assignee: E. I. Du Pont De Nemours and Company, Wilmington, Del.

[21] Appl. No.: 696,200

[22] Filed: Jan. 29, 1985

Related U.S. Application Data

[63] Continuation-in-part of Ser. No. 576,602, Feb. 3, 1984, abandoned, which is a continuation-in-part of Ser. No. 493,916, May 12, 1983, abandoned.

[51] Int. Cl.[4] ..... C06B 45/02

[52] U.S. Cl. ..... 149/21; 149/2; 149/46; 149/109.6; 149/110; 102/313

[58] Field of Search ..... 149/2, 21, 109.6, 110, 149/46; 102/313

[56] References Cited

U.S. PATENT DOCUMENTS

| | | | |
|---|---|---|---|
| 3,161,551 | 12/1964 | Egly et al. | 149/46 |
| 4,111,727 | 9/1978 | Clay | 149/2 |
| 4,181,546 | 1/1980 | Clay | 149/21 |
| 4,287,010 | 9/1981 | Owen, II | 149/2 |
| 4,357,184 | 11/1982 | Binet et al. | 149/2 |
| 4,404,050 | 9/1983 | Yorke et al. | 149/85 X |
| 4,420,349 | 12/1983 | Bampfield | 149/85 X |

FOREIGN PATENT DOCUMENTS

| | | |
|---|---|---|
| 1306546 | 2/1973 | United Kingdom . |
| 2004265A | 3/1979 | United Kingdom . |
| 2050340A | 1/1981 | United Kingdom . |
| 2055358A | 3/1981 | United Kingdom . |
| 2125782A | 3/1984 | United Kingdom . |

*Primary Examiner*—Stephen J. Lechert, Jr.
*Attorney, Agent, or Firm*—Diamond C. Ascani

[57] ABSTRACT

Explosives that are sensitized blends of a water-in-oil emulsion and inorganic nitrate, e.g., AN, particles, such as AN or ANFO prills, have improved stability when their structure hinders the loss of water from the aqueous emulsion phase and transportation of such water across the oil phase to the nitrate particles. Use of an anionic emulsifying agent comprising a fatty acid salt, e.g., as formed in situ during the formation of the emulsion, is the preferred way of forming such a blend-stabilizing structure. Emulsion/nitrate blends stabilized in this manner make satisfactory storage-stable packaged products. Emulsion/nitrate blends made with a new low-viscosity emulsion containing essentially all of the oil required to oxygen-balance the blend and a proportionately larger amount of anionic emulsifying agent to stabilize the emulsion structure constitute preferred bulk products owing to their greater adaptability to pumping. Pumping the stabilized blends through an annular stream of aqueous lubricating liquid is advantageous.

56 Claims, 3 Drawing Figures

STABLE NITRATE/EMULSION EXPLOSIVES AND EMULSION FOR USE THEREIN

CROSS-REFERENCE TO RELATED APPLICATION

This application is a continuation-in-part of now abandoned application Ser. No. 576,602, filed Feb. 3, 1984, which is a continuation-in-part of now-abandoned application Ser. No. 493,916, filed May 12, 1983.

BACKGROUND OF THE INVENTION

1. Field of the Invention

The present invention relates to explosive compositions comprising a sensitized blend of a water-in-oil emulsion and solid particulate inorganic nitrate, preferably ammonium nitrate (AN), in the form of prills or granules which may be coated with fuel oil (e.g., ANFO), and more particularly to such compositions in the form of storage-stable packaged products and bulk products adapted to be pumped into boreholes. The invention also relates to a low-viscosity emulsion particularly adapted to be blended with fuel-free or -deficient solid inorganic nitrate to form such a blend.

2. Description of the Prior Art

Explosives which comprise a blend of a water-in-oil emulsion and solid particulate AN (e.g., ANFO) have captured the interest of blasters in recent years owing to the fact that they are able to offer the advantages of high bulk density, blasting energy, and water resistance characteristic of emulsion explosives, while at the same time resulting in cost reductions owing to the lower cost of the AN. Among the problems that may be encountered in connection with the use of these blends, however, are those of blend pumpability and blend stability, more particularly of the stability of the blend's explosive properties. Some blends are not pumpable, or only difficulty pumpable. Some must be pumped immediately after they have been formed because they do not retain their pumpability even for a day or two. While there is no question but that the blend must have a sufficiently long shelf life as to be detonable after it has been emplaced in a borehole, this matter has not been dealt with to any significant degree in most of the prior art sources on emulsion/AN blends. Nevertheless, it is a fact that not all packaged blends are detonable by the time they are to be used, even if the packages have been stored for only a short time.

Emulsion/AN blends are described in U.S. Pat. Nos. 3,161,551 (Egly et al.); 4,111,727 (Clay); 4,181,546 (Clay); and 4,357,184 (Binet et al.), and British Pat. No. 1,306,546 (Butterworth). Egly et al. describe an emulsion/AN blend wherein the emulsion, said to be in a sensitized form, is employed as a sensitizer for the solid ammonium nitrate. Regarding the delivery of the blend into a borehole, the patentees describe forming the blend in the borehole itself, i.e., by dropping the AN into the hole and pouring the sensitized emulsion over it.

Clay, whose 10/90 to 40/60 emulsion/AN blends in U.S. Pat. No. 4,111,727 are sensitized only by the air entrapped in the AN, states that the emulsion and AN particles are combined by very simple procedures, preferably just prior to insertion into the borehole. Clay also states that sorbitan monooleate, sorbitan monostearate, and sorbitan monopalmitate are quite suitable emulsifiers for making his emulsion, and that the emulsifiers preferably are blended into the oil before the aqueous component is added. Clay's AN may be oxygen-balanced ANFO (to be blended with an oxygen-balanced emulsion), or fuel-deficient or fuel-free solid AN (to be blended with an emulsion that contains most or all of the oil required to oxygen-balance the blend).

In U.S. Pat. No. 4,181,546, Clay describes 40/60 to 60/40 emulsion/AN blends having completely filled interstices in and between the AN particles. This product is said to contain too high a proportion of dry ingredient to be pumpable in conventional slurry pumps, but is said to be deliverable to a borehole by an auger in the same manner as dry ANFO. This patent advises minimizing the amount of emulsifier, and using high shear mixing, to insure a stable emulsion. Clay describes sorbitan fatty acid esters as being particularly suitable emulsifiers, and "Glycomul 0" (sorbitan monooleate) as superior to most for his invention.

Butterworth describes loading his blend into an 8.3-cm-diameter polyethylene tube, priming the charge with nitroglycerin, and detonating the charge one hour after mixing. Thus, Egly et al., Clay, and Butterworth do not address themselves to such matters as blend stability, i.e., the condition of the blend after it has been allowed to stand for several days or weeks before or after packaging, or before delivery in bulk form to a borehole.

The emulsion portion of Binet et al.'s explosive composition is termed a "microemulsion", and it contains an amphiphatic synthetic polymer emulsifier, along with a conventional water-in-oil emulsifier. Optionally, a phosphatide emulsion stabilizer is included. Binet et al.'s microemulsion per se, described as a "liqui-liquid foam" of very small cell size ranging from less than 1 micron to about 15 microns, is said to display exceptional long-term storage stability and to be tolerant to doping with further fuel and energy-enhancing ingredients. The patentees discuss a destabilizing seeding crystal effect in prior art emulsion explosives resulting from the presence of solid oxidizer salts in the basic emulsion. According to Binet et al., their findings show that their microemulsion, when doped with 24 percent ground AN, was much more stable to this seeding crystal effect than a prior art emulsion, and remained cap-sensitive for three cycles, each consisting of 3 days of storage at 50° C. followed by 2–3 days at −17° C.

Binet et al.'s consideration of storage stability is directed for the most part at the explosive emulsion itself. The patentees mention that all known prior art water-in-soil emulsions suffer from lack of stability owing to the seeding effect. Binet et al. also imply that the seeding effect is a problem in AN-doped emulsions, although they do not explain how this can be so in microemulsions containing relatively large AN particles. Moreover, Binet et al. require an expensive polymeric emulsifier, and an optional emulsion stabilizer, to achieve improved stability in their microemulsion.

AN/emulsion blends having good storage stability, and a method of making such blends which does not require the use of expensive additives, of perhaps limited utility, are greatly needed to expand the spectrum of AN/emulsion products that can be made available to the public. In particular, blends are needed which are pumpable into a borehole even a few days after having been formed, as well as detonable after having been delivered into a borehole in packaged form after a period of about three months of more from the time the blends were made.

SUMMARY OF THE INVENTION

The present invention provides an improvement in a method of preparing an explosive composition by combining particles of an inorganic nitrate, preferably ammonium nitrate (AN), e.g., AN or ANFO prills, with a water-in-oil emulsion comprising (a) a liquid carbonaceous fuel having components which form a continuous emulsion phase, (b) an aqueous solution of an inorganic oxidizing salt forming a discontinuous emulsion phase dispersed as discrete droplets within the continuous phase, and (c) an emulsifying agent to form a blend of the nitrate particles and the emulsion, which blend contains a sensitizing amount of dispersed gas bubbles or voids. The improvement of the invention comprises forming the nitrate particles and the components of the emulsion into a structure that minimizes the loss of water from the aqueous solution droplets and the transportation of the water across the continuous phase to the nitrate paticles mixed with the emulsion. Preferably, this structure includes an emulsion which, when subjected to the following Water Diffusion Test, loses an amount of water that is no more than about 4 percent of the original emulsion weight:

A cylindrical pan of 7.5 mm radius and 2.6 mm height is filled with 0.325 cc of freshly prepared emulsion, which is the same emulsion as that which has been used to prepare the blend. The emulsion's flat exposed surface of 1.25 $cm^2$ area is contacted with a cylindrical pellet of an inorganic nitrate having the same cross-sectional area as the emulsion sample and a height of at least 1 cm. The nitrate is the same as that which has been used to prepare the blend. The emulsion/nitrate sample is stored for 48 hours in dry air at 25° C., after which time the emulsion is analyzed for water loss.

In a preferred method of the invention the described structure that hinders water loss and transport is formed by combining the nitrate particles with an emulsion which contains, in its emulsifying system, (a) a salt, preferably an alkali metal, ammonium, and/or alkylammonium salt, of a fatty acid (preferably selected from the group consisting of saturated and mono-, di-, and tri-unsaturated monocarboxylic acids containing about from 12 to 22 carbon atoms), as well as (b) the free fatty acid, the latter being in solution in an oil, the oil solution constituting the continuous emulsion phase, and the fatty acid and fatty acid salt, together with said oil, forming said liquid carbonaceous fuel. Most preferably, the fatty acid salt emulsifying system is one which has been produced in situ from a fatty acid and a base when the oil and the aqueous solution of the inorganic oxidizing salt have been combined to form the emulsion. With this emulsifying system a base, e.g., hydroxide, is present in the emulsion's aqueous phase.

An alternative, or preferably supplemental, way of forming the structure that controls water transport between the aqueous solution droplets and the nitrate particles is to provide a droplet cell size of at least about 1, and preferably no greater than about 4, microns. Still alternatively, or additionally, the structure will be formed by coating the nitrate particles with a substance in which water has a diffusion coefficient at 25° C. of less than about $10^{-5}$ $cm^2$/sec.

Also provided by this invention is a storage-stable packaged explosive product made by one embodiment of the method of the invention and comprising an aged blend of preferably at least about 30 percent by weight of particles of an inorganic nitrate, e.g., ANFO prills, and preferably at least about 30 percent by weight of an emulsion comprising (a) a liquid carbonaceous fuel including an oil solution of a fatty acid, said solution forming a continuous emulsion phase, (b) an aqueous solution of an inorganic oxidizing salt forming a discontinuous emulsion phase dispersed as discrete droplets within the continuous phase, and (c) an emulsifying system including an emulsifying agent comprising a salt, preferably an alkali metal, ammonium, or alkylammonium salt, of a fatty acid (preferably selected from the group consisting of saturated and mono-, di-, and tri-unsaturated monocarboxylic acids containing about from 12 to 22 carbon atoms), as well as the free fatty acid, the fatty acid and fatty acid salt, together with said oil, forming said liquid carbonaceous fuel, said blend containing a sensitizing amount of dispersed gas bubbles or voids, e.g., an amount which may be at least about 5 percent of the volume of the blend, and whose structure is such that the amount of water lost from the aqueous solution droplets in the emulsion when aged at 25° C. for 2 days is no more than about 4, and preferably no more than about 3.5, percent of the original emulsion weight, as measured by the above-described Water Diffusion Test. In a preferred embodiment, the emulsion has a droplet cell size of at least about 1, and preferably no greater than about 4, microns.

The term "aged" is used herein to distinguish the packaged product of the invention from products which are made at the site of use and delivered into a borehole in bulk form. An "aged" product denotes herein a product which is packaged and transported to the field site at some later date, usually at least several days, and often weeks, after the time of manufacture.

The term "particles of inorganic nitrate" as used herein to describe the solid material that is present in the product of the invention in a blend with an emulsion denotes a solid inorganic oxidizing salt which may be ammonium nitrate, an alkali metal nitrate, e.g., sodium nitrate (SN), or an alkaline-earth metal nitrate, e.g., calcium nitrate (CN), or any combination of two or more of such nitrates, in the form of granules or prills, e.g., fuel-free or fuel-deficient prills, or prills lightly coated with fuel oil, e.g., the well-known "ANFO", in which the usual AN/FO weight ratio is about 94/6, and/or coated according to the method of the invention, as will be described hereinafter. An prills and ANFO are preferred.

In a further embodiment, the present invention provides a water-in-oil emulsion adapted to be blended with inorganic nitrate prills by one embodiment of the method of the invention to form a stable explosive, said emulsion comprising (a) about from 7 to 21 percent, preferably about from 9 to 15 percent, by weight of a liquid carbonaceous fuel including an oil solution of a fatty acid, said solution forming a continuous emulsion phase;

(b) an aqueous solution of an inorganic oxidizing salt forming a discontinuous emulsion phase dispersed as discrete droplets within the continuous phase; and (c) an emulsifying system comprising (1) said fatty acid and (2) a fatty acid salt, the oil, fatty acid, and the fatty acid salt together forming the liquid carbonaceous fuel, and the ratio of the amounts of oil and fatty acid added to form the emulsion being in the range of about from 1/1 to 3/1 by weight; said emulsion having an oxygen balance more negative than about −6 percent, e.g., as negative as about −50 percent.

In a preferred emulsion, in which the emulsifying system is one which has been produced in situ from the fatty acid and a base when the oil and the aqueous salt solution have been combined to form the emulsion, a base is also present, as a result of the addition of base and fatty acid in an equivalents ratio of about from 0.5/1 to 3/1, preferably about from 1.5/1 to 2/1. In the above-specified oil to fatty acid ratio in this particular emulsion, the fatty acid weight should be understood to be the weight of fatty acid added to form the emulsion. Some of this becomes converted to the fatty acid salt emulsifier. This emulsion has a viscosity generally in the range of about from 500 to 10,000 poise, and about from 500 to 3,000 poise from bulk products. The emulsion structure is stable for a period of about 3 months or more.

In the emulsion product made by adding a preformed fatty acid salt to the system, the "fatty acid" weight in the above-specified oil to fatty acid ratio should be understood to be the weight of fatty acid added plus the weight of fatty acid salt added when the emulsion is being made. In this product the ratio of the weight of fatty acid salt (added) to the weight of fatty acid (added) is at least about 0.5/1.

The amount of inorganic oxidizing salt (the oxidizer) present in the "high oil" emulsion of the invention is insufficient for the complete combustion of the fuel therein, as is evidenced by the emulsion's negative oxygen balance. This oxidizer-deficient emulsion is converted into a product having a more positive oxygen balance and satisfactory explosive properties by blending with fuel-deficient or, preferably, substantially fuel-free inorganic nitrate, preferably AN, prills. By virtue of its relatively low viscosity, the oxidizer-deficient emulsion can be blended with these prills with low shear so as to produce a preferred explosive emulsion/-nitrate blend of the invention containing about from 20 to 70 percent by weight of prills and a sensitizing amount of dispersed gas bubbles or voids, the blend being essentially oxygen-balanced, i.e., having an oxygen balance more positive than about −25 percent, and preferably in the range of about from −10 to +5 percent. Blends made from the preferred in situ emulsion and about from 20 to 50 percent prills have a viscosity in the range of about from 2500 to 20,000 poise, a viscosity in this range being maintainable for a period of several days.

BRIEF DESCRIPTION OF THE DRAWING

In the accompanying drawing, which consists of plots of data obtained in the experiments described in Examples 1, 2, and 7.

DETAILED DESCRIPTION

Figure 1:
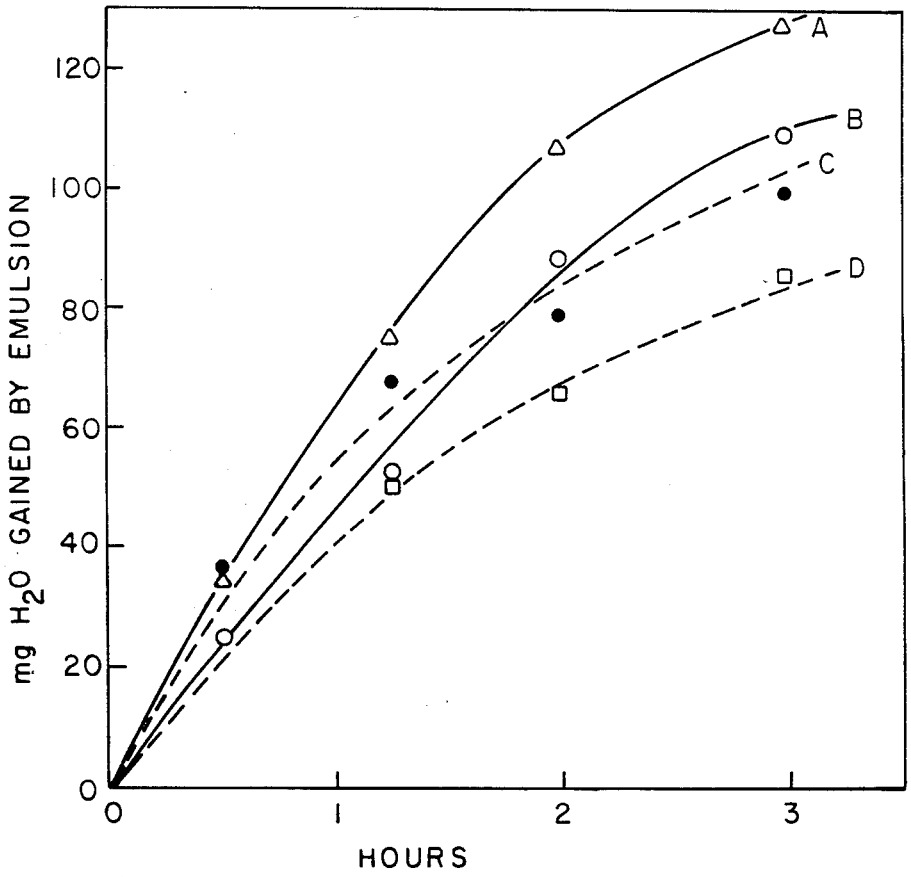
FIG. 1 is a plot of the rate at which water is transported into an emulsion used in a product of this invention, as contrasted to an emulsion used in a product of the prior art.

The present invention is based on the discovery that the transport of water from the dispersed aqueous phase of the emulsion to the nitrate particles that are intermixed with the emulsion in nitrate/emulsion blends plays a major role in the instability of these blends, leading to a deterioration of product performance. This transfer of water results in an increase in the water content of the particulate nitrate, perhaps to a level of about 5 to 10 percent, and an increase in the salt concentration in the dispersed aqueous phase, approaching the saturation limit and the possibility that the salt may crystallize out. These combined effects can cause the structure of the emulsion/nitrate blend to deteriorate rapidly.

In the method of the invention, the inorganic nitrate particles and the components of the emulsion, by virtue of their chemical composition and physical properties (e.g., size and spatial relationships), are formed into a structure in the emulsion/nitrate blend that minimizes the loss of water from the droplets of aqueous salt solution, and transportation of the water across the emulsion's continuous phase to the inorganic nitrate particles. This structure provides a medium or barrier resistive to water-transport formed preferably by a substantially hydrophobic continuous emulsion phase, most preferably obtained when the emulsifying system contains a salt, preferably an alkali metal, ammonium, and/or alkylammonium salt, of a fatty acid (e.g., a saturated or mono-, di-, or tri-unsaturated monocarboxylic acid containing about from 12 to 22 carbon atoms), as well as the free fatty acid in solution in an oil, the oil solution of the acid forming the emulsion's continuous phase, and the oil, fatty acid, ad fatty acid salt together forming the liquid carbonaceous fuel. Most preferably, this emulsifying system is formed in situ by combining the oil and the aqueous solution in the presence of a fatty acid and a base, according to the method described in U.S. Pat. No. 4,287,010 (Owen). It has been suggested that the Owen in situ method may allow the fatty acid salt (soap) emulsifying agent to form at the oil/water interface, where it is present together with free fatty acid, whereby a stabilizing equilibrium is believed to be established between the acid/soap at the interface, fatty acid in the oil phase, and base in the aqueous phase.

In a most preferred embodiment of the method of the invention, therefore, the emulsifying system is one which has been produced by the in situ formation of a salt, preferably an alkali metal, ammonium, or alkylammonium salt, of a fatty acid (preferably a saturated or mono-, di-, or tri-unsaturated monocarboxylic acid containing about from 12 to 22 carbon atoms), most preferably sodium, potassium, and/or ammonium oleate, according to techniques described in the aforementioned Owen patent.

The importance (to the stability of emulsion/nitrate blends) of a blend structure provided by an emulsion containing a hydrophobic continuous emulsion phase, and more particularly a relatively nonpolar emulsifying system that produces such a continuous phase, has not heretofore been recognized. In fact, Clay (U.S. Pat. No. 4,181,546) says that he found the (non-ionic) sorbitan oleate type to be among the most satisfactory emulsifiers. Binet et al. suggest that stability is dependent on the presence of a graft, block, or branch polymeric emulsifier in combination with conventional emulsifiers. High concentrations of the polar non-ionic emulsifiers in the oil layer render it relatively hydrophilic and therefore capable of transporting water to the inorganic nitrate particles at a rapid rate, leading to the product instability described above. The benefit of the hydrophobic oil layer, as contrasted to the more hydrophilic oil layer preferred by Clay, is shown in Examples 1 and 2 which follow.

The above-described control of the emulsifying system is the preferred way of providing a structure wherein a hydrophobic medium is present between the aqueous droplets in the emulsion and the inorganic nitrate particles. An alternative method, useful with any emulsifying system but preferably in conjunction with the preferred emulsifying system described above, is to coat the nitrate particles with a substance in which water diffusivity is low, e.g., in which water has a diffusion coefficient at 25° C. of less than about $10^{-5}$, and preferably less than about $10^{-8}$, $cm^2/sec$. Preferred coating materials are those which, when used in an amount constituting a 6–10 percent of the amount of solid nitrate used, can act as a fuel to oxygen-balance the solid nitrate. Such materials could replace the fuel oil (FO) normally used in ANFO for example. Examples of such materials are solid or semi-solid hydrocarbons including paraffin wax and petrolatum-rosin-paraffin.

In a further preferred embodiment of the invention, the required structure formed by the inorganic nitrate particles and the components of the emulsion is provided by controlling the cell size of the emulsion's internal phase (the aqueous salt solution droplets) so as to decrease the chemical driving force, i.e., the difference between the chemical potential of the water in the dispersed aqueous salt solution of the emulsion and the inorganic nitrate particles. A reduced chemical driving force minimizes the rate of water transport from the aqueous emulsion phase to the nitrate particles. The chemical potential of the components in the dispersed aqueous phase increases in inverse proportion to the radius of curvature of the cell (droplet). Therefore, smaller cell size increases the chemical potential of the water in the discontinuous phase, thereby increasing the driving force for water transport to the solid oxidizer. In the past, a smaller cell size (higher viscosity) has been recommended to increase the stability of emulsion explosives per se. For example, Clay (U.S. Pat. No. 4,181,546) recommends "a good shearing mixing" as well as "a good emulsifier" (sorbitan oleate type) to obtain a good stable emulsion. As is discussed above, the situation is different for emulsion/nitrate blends. The optimum cell size of the internal phase of an emulsion in a blend is the largest that will not crystallize on losing water over the goal shelf life of the product. This insures a minimum rate of water transfer, without premature crystallization of the emulsion. The optimum cell size generally is from about 1 to about 4 microns, decreasing as the aqueous phase water content decreases.

Other factors also can be controlled to minimize water transport across the emulsion's continuous phase. Since the rate of water transport not only is determined by the composition of the continuous phase but also is decreased when the dimensional thickness of this phase is greater, the continuous phase can be made dimensionally thicker by increasing the oil content of the emulsion. Therefore, a preferred product of the invention, especially for use in bulk emulsion/nitrate blends, is a "high oil" emulsion that contains a portion, and preferably substantially all, of the oil required to oxygen-balance the solid inorganic nitrate to be blended therewith. This is beneficial for several reasons. First, the added oil imparts a lower viscosity to the emulsion. Low viscosity is of great benefit in that it permits the formation of emulsion/nitrate blends with lower shear mixing, which has an advantageous effect on the stability of the blend. Lower shear mixing is especially important in making blends having a high content of solid inorganic nitrate because the movement of the particles past each other during mixing performs work on the emulsion between them which may break the oil film that separates the particles from the aqueous solution droplets, thereby giving water transport a "head start". With the "high oil" emulsion of the invention, and particularly the preferred emulsion in which the emulsifying system is formed in situ, a more stable blend results because the components can be mixed with less shear than that used in blending a more viscous emulsion, and a less viscous, more easily pumpable blend results. Moreover, as will be explained more fully hereinafter, the lower viscosity of the blend is sufficiently stable, at least for several days, so that the advantage of ease of pumping is retained even if a few days elapse between the time when the blend is made and the time when it is pumped.

As has been stated above, increasing the oil content of the emulsion so as to increase the dimensional thickness of the emulsion's continuous phase will increase the resistance to the transport of water across the continuous phase to the inorganic nitrate particles. However, the uncontrolled enlargement of the emulsion's continuous phase often causes the separation or "creaming" of the oil.

It now has been found that in certain specific systems a "high oil" emulsion having an emulsion structure that is stable, i.e., a structure in which there is no "creaming" of the oil phase, can be achieved if the concentration of the emulsifying agent is higher than that used in standard "low oil" emulsions, i.e, essentially oxygen-balanced emulsions which are to be blended with ANFO. If the emulsifying agent is a salt of a fatty acid used in conjunction with the free fatty acid, which is in solution in the oil, and especially if the salt of a fatty acid has been formed in situ as described in U.S. Pat. No. 4,287,010, the stable, low-viscosity emulsion (i.e., the "high oil" emulsion which contains proportionately more emulsifying agent) forms blends with the solid nitrate having a stable viscosity which remains low enough to facilitate pumping even if the blend "ages" a day or so before pumping.

Non-ionic emulsifying agents, such as those of the sorbitan fatty acid ester type, have been stated in the prior art, i.e., in U.S. Pat. No. 4,181,546 (Clay), as having been found to be among the most satisfactory emulsifiers for emulsions, with respect to stability. A new finding, however, is that emulsion/nitrate blends made from "high oil" emulsions containing an emulsifying agent in a concentration that is sufficiently high to preserve the emulsion structure are unstable with respect to viscosity levels when the emulsifying agent is sorbitan monooleate. In the latter case, despite the lower viscosity of the "high oil" emulsion used to form the blend, water transport from the aqueous phase and the possible crystallization of the salt therein can cause the blend viscosity to rise at an extremely rapid rate to a level at which the blend is no longer pumpable and subsequently not detonable. This level may be reached within a day or two. Accordingly, viscosity stability is not a characteristic of "high oil" emulsion/nitrate blends in general, but is dependent upon the nature of the emulsifying system present in the "high oil" emulsion.

Another benefit of forming blends of the "high oil" emulsion of the invention and oil-free or oil-deficient nitrate prills is that the inclusion of all of the required oil in the emulsion to begin with permits the oil to fatty acid ratio to remain essentially undisturbed in the transition from the unblended to the blended emulsion, hence preserving the required emulsifier level.

Assuming that the preferred "high oil" emulsion of the invention is intended for blending with 20 to 70 percent nitrate prills, the amount of liquid carbonaceous fuel (oil plus fatty acid plus fatty acid salt) present in this emulsion generally will be in the range of about from 7 to 21 percent, based on the total emulsion weight. The amount of liquid carbonaceous fuel in this emulsion is higher as the prill content of the blend in which it is to be used is higher. In the preferred blend range of 40/60 to 60/40 emulsion/prills, the emulsion's liquid fuel content ranges about from 9 to 15 percent by weight, and is no more than about 13 percent in emulsions to be used in bulk products, in which it is beneficial to use no more than about 50 percent prills to facilitate pumping.

The amounts of inorganic oxidizing salt(s) and water present in the aqueous phase of the "high oil" emulsion are within the broad ranges specified for these components in U.S. Pat. No. 4,287,010, i.e., about from 50 to 95 percent oxidizing salt(s) and about from 5 to 25 percent water, by weight. However, within these ranges, higher water concentrations, i.e., about from 12 to 20 percent, are preferred in this emulsion. The content of inorganic oxidizing salt(s), liquid carbonaceous fule, and water of "low oil" emulsions used in the present method and in the packaged product of the invention will be as described in U.S. Pat. No. 4,287,010.

In the preparation of the emulsifying system according to the in situ method described in the aforementioned U.S. Pat. No. 4,287,010, the disclosure of which is incorporated herein by reference, a fatty acid, e.g., oleic acid, and a base are brought together at the same time as an aqueous solution of an inorganic oxidizing salt and an oil, whereby a fatty acid salt emulsifying agent forms in situ as a water-in-oil emulsion forms. Present in the resulting emulsion is the fatty acid salt, together with the fatty acid (in the oil phase). Base is also present, in the aqueous phase.

The fatty acid salt emulsifying agent used in the preferred embodiment of the present method may be a salt of a saturated or mono-, di-, or tri-unsaturated monocarboxylic acid containing at least about 12, and usually no more than about 22, carbon atoms. Examples of such acids are oleic, linoleic, linolenic, stearic, isostearic, palmitic, myristic, lauric, and brassidic acids. The free fatty acid present may be selected from this same class of monocarboxylic acids. Oleic and stearic acids are preferred on the basis of availability. In "high oil" emulsions to be delivered in bulk form, a fatty acid, e.g., oleic acid, which is liquid at the temperature at which the blend is expected to be used should be selected. Usually, this will be an unsaturated monocarboxylic acid. The cation portion of the fatty acid salt preferably is an alkali metal (e.g., sodium, potassium, or lithium), ammonium, or mono-, di-, or trialkylammonium ion in which the alkyl group(s) preferably contain 1–3 carbon atoms. Sodium, potassium, and ammonium oleates are preferred.

As may be seen from Example 6 which follows, the emulsion structure of the "high oil" emulsion of the invention is many times more stable than a comparable emulsion containing a lower emulsifier concentration. To provide the higher emulsifier concentration in the "high oil" emulsion, the weight ratio of oil to fatty acid added to form the emulsion should be in the range of about from 1/1 to 3/1. If pre-formed fatty acid salt is used (i.e., added) to form the emulsion, the weight of "fatty acid" in this ratio should be understood to be the weight of fatty acid added plus the weight of fatty acid salt added, and the ratio of fatty acid salt (added) to fatty acid (added), by weight, should be at least about 0.5/1. The base/acid equivalents ratio used to form the "high oil" emulsion by the in situ method should be in the range of about from 0.5/1 to 3/1, preferably about from 1.5/1 to 2/1.

In the present invention, oils and aqueous inorganic oxidizing salts solutions known to the explosive emulsion art may be employed, preferably those disclosed in the aforementioned U.S. Pat. No. 4,287,010. Most often, the inorganic oxidizing salt present in the emulsion's aqueous phase will be an ammonium, alkali metal, or alkaline earth metal nitrate or perchlorate, preferably ammonium nitrate, alone or in combination with, for example, up to 50 percent sodium nitrate (based on the total weight of inorganic oxidizing salts in the aqueous phase). Salts having monovalent cations are preferred, as explained in U.S. Pat. No. 4,287,010. Suitable oils for use in the liquid carbonaceous fuel include fuel oils and lube oils of heavy aromatic, naphthenic, or paraffinic stock, mineral oil, dewaxed oil, etc.

The "high oil" emulsion of the invention is formed by agitating the aqueous oxidizing salt solution and the oil solution of the fatty acid in the presence of the fatty acid salt under conditions which result in a stable emulsion of a selected viscosity. In the preferred in situ system the base preferably is dissolved in the aqueous solution, which is agitated with the oil solution of the fatty acid.

This emulsion may be blended with nitrate prills (or granules) by pumping it into a mixer or into an auger conveying the nitrate. The latter mode is convenient for making a packaged product. The turning of the screw in the auger blends the emulsion and prills as well as transfers the blend into the package. The low viscosity of the emulsion allows the mixing to be done in a shorter auger length with less shear, resulting in improved shelf life over blends made with high shear.

If the blend of "high oil" emulsion and nitrate prills is to be used in bulk form, e.g., by pumping it from a mixer and into a borehole, perhaps after standing in the mixer for a day or so, the blend remains in a form suitable for pumping after such time owing to its viscosity stability, as is shown in Example 7. The viscosity of a freshly made blend of an emulsion made by the in situ method and containing about from 20 to 50 percent prills generally is in the range of about from 2500 to 20,000 poise, and the blend maintains a viscosity in this range for a period of several days, sufficient to enable pumping to be undertaken during such time.

The inorganic nitrate, preferably AN, with which the "high oil" emulsion is blended is an oil-deficient product, preferably substantially oil-free prills. To produce a blend which is to be pumped, sufficient prills are used to produce a blend having a prill content of from about 20 to 50 percent by weight. Up to 70 percent prills may be used for a packaged product.

The emulsion/prill blend of the invention, whether made with oil-free or oil-containing prills, is in a sensitized form so that it is detonable by means customarily used to initiate explosives. For this reason the blend contains a sensitizing amount of dispersed gas bubbles or voids (based on blend volume). This void or gas volume can be that of the prills per se (see Examples 5, 6, 9 and 10), or auxiliary gas can be incorporated, e.g., by adding other air-carrying solid materials, for example, phenol-formaldehyde microballoons, glass microballons, fly ash, etc. If materials of the latter type are to be present in the blend, they may constitute a component of the emulsion or they may be added at the time of blending. With blends containing less than about 50 percent prills and destined to be used to packaged products, it may be desirable to provide an auxiliary source of dispersed gas or voids, such as microballoons, in the blend for the sensitization thereof.

As was mentioned previously, the fatty acid salt emulsifying system is the preferred means of providing the structure that minimizes water loss and transport in the method of the invention. This means is used to best advantage when the fatty acid salt emulsifying system is used in conjunction with high oil content, cell size control, and/or nitrate particle coating, etc. However, in the present method the latter techniques can be used with other emulsifying systems.

The present method is used to advantage in the preparation of blends which contain about from 20 to 70 percent nitrate, preferably AN, particles by weight. The need for a water transport barrier and/or decreased chemical driving force generally is not great with blends containing less than about 20 percent solid nitrate. The solid nitrate content usually will be in the range of about from 30 to 70 percent by weight for a packaged blend, and about from 20 to 50 percent by weight for a pumped blend.

Explosives which are blends of a water-in-oil emulsion and nitrate, preferably AN or ANFO, prills having a physical and chemical structure that minimizes water loss and transport from the emulsion's aqueous phase according to the method of the invention, and especially blends of the "high oil" emulsion of the invention and nitrate prills, are useful in bulk as well as packaged form. The emulsion/nitrate blend of the invention made with the low-viscosity "high oil" emulsion, and particularly the preferred "in situ" emulsion, is especially suited for pumping operations. A preferred technique for pumping the blend into a borehole is to pump it through an annular stream of aqueous lubricating liquid, e.g., naturally occurring water, flowing through the conduit used to transfer the blend to the hole. Such a technique is described in U.S. Pat. No. 4,462,429, issued July 31, 1984, to D. L. Coursen, for pumping a Bingham solid, e.g., a water-in-oil emulsion explosive. By use of a method and apparatus of the type described in the Coursen patent, the disclosure of which is incorporated herein by reference, the resistance of the emulsion/nitrate blend to movement through a conduit is reduced by provision of an annular layer of liquid of low viscosity, e.g., water, around a central column of the blend in the conduit. An annulus of aqueous lubricating liquid, injected into the conduit through which the emulsion/nitrate blend is to be delivered to the borehole, provides lubrication sufficient to permit a column of the blend to slide through the conduit without undergoing appreciable deformation in shear, i.e., movement in "plug flow", a distinct benefit for maintaining the emulsion structure of the blend. An additional benefit of using this apparatus is that it is more effective when used with small amounts of lubricant, which assures better control of the strength and sensitivity of the explosive blend owing to the decreased risk of dilution. A lubricating liquid flow rate which is no greater than about 5%, and usually no greater than about 0.5–2%, of the emulsion/nitrate blend flow rate is used.

When the pumping is carried out at temperatures above 0° C., water is the preferred lubricating liquid, on the basis of low cost, low viscosity, and immiscibility with the emulsion/nitrate blend being pumped. Additives such as ethylene glycol may be added to the water to reduce its freezing point during cold weather. The water need not be of high purity or even potable. Therefore, any naturally occurring water available at the field site of use can generally be used even though such waters, whether from steams, wells, or the sea, invariably contain some dissolved salts.

The above-described annular lubricant method can be carried out with intermittent pumping, if desired, even in the case in which water is the lubricating liquid. In contrast to the process described in U.S. Pat. No. 4,259,977 for pumping emulsions, in the present process, in which the material being pumped is an emulsion laden with solid nitrate, plugging of the delivery conduit does not occur on stoppage of the pumping operation when a water annulus is used. It is believed that the avoidance of the swelling/plugging problem in the annular lubricant pumping method is related to the nature of the continuous phase in the explosive emulsion used in the present blend, and more particularly to the hydrophobicity thereof resulting from the emulsifying agent or system therein. It is possible that the fatty acid salt, and especially the equilibrium structure of the emulsifying system produced when the emulsifying agent is formed in situ, as is described in the aforementioned U.S. Pat. No. 4,287,010, provide a uniquely hydrophobic environment between the lubricating liquid on the outer surface of the emulsion/nitrate blend and the aqueous phase droplets within the blend, thereby preventing the absorption of the lubricating liquid into the blend despite the presence of a concentration gradient between the lubricating liquid and the aqueous phase droplets. In any event, a matching of such concentrations is unnecessary with the present blends, and any available water supply can be used to provide the lubricating liquid.

The method, emulsion, and emulsion/nitrate blends of the invention will now be described by means of illustrative examples.

EXAMPLE 1

The rate of absorption of water into samples of four different emulsions was measured as an estimate of the relative rates of water transport through these emulsions in emulsion/nitrate blends. The compositions of the samples are shown in the following table. Samples B, C, and D, which are samples of "low oil" emulsions that would be used, for example, in packaged ANFO blends of this invention, were prepared by the method described in Example 1 of U.S. Pat. No. 4,287,010, with variations in mixer speeds as will be described. The percentages given for oleic acid and ammonium hydroxide represent the proportions used to prepare ammonium oleate in situ. Sample A is a sample of an emulsion of the type described in U.S. Pat. No. 3,447,978, in which a non-ionic emulsifying agent is present.

| | Sample | | | |
|---|---|---|---|---|
| | A | B | C | D |
| Ammonium Nitrate | 75.3 | 58.9 | 72.9 | 72.9 |

-continued

| | Sample | | | |
|---|---|---|---|---|
| | A | B | C | D |
| (dissolved), % | | | | |
| Sodium Nitrate (dissolved), % | — | 13.2 | — | — |
| Water, % | 16.3 | 5.9 | 15.1 | 15.1 |
| Oil, % | 6.0 | 3.9 | 3.9 | 3.9 |
| Oleic Acid, % | — | 2.0 | 2.0 | 2.0 |
| Ammonium Hydroxide, % | — | 0.5 | 0.5 | 0.5 |
| Sorbitan Monoleate, % | 1.1 | — | — | — |
| Glass Microspheres, % | 1.3 | — | — | — |
| Fly Ash, % | — | 5.6 | 5.6 | 5.6 |
| Mole Fraction of Water in Aqueous Phase | 0.49 | 0.49 | 0.48 | 0.48 |
| Density, g/cc | 1.25 | 1.30 | 1.29 | 1.29 |
| Relative Cell Size: A < D < C ≅ B | | | | |

To test the water absorption rate, the samples were loaded into cylindrical pans of 7.5 mm radius and 2.6 mm height. The samples were submerged under 25.4 mm of water. At various time intervals, a sample was removed, excess water blotted off, and the moisture content measured by Karl Fischer analysis. The results are shown in FIG. 1.

The effect of cell size on the rate of water absorption into the sample is seen by comparing the curves for C and D, which were the same emulsion sheared at different mixer tip speeds to yield different viscosities and cell sizes. The viscosity of C was 1900 poise at 23° C., and the viscosity of D 4550 poise at 23° C., representing the smaller cell size. Because of its smaller cell size, the aqueous phase of D had a higher chemical potential than the aqueous phase of C, resulting in a lower driving force for water transport into the emulsion. After 3 hours, C had gained about 18 percent more water than D.

The effect of the type of emulsifying system on the water absorption rate is more pronounced than the effect of cell size, as can be seen by comparing B, C, or D to A. Although A had the smallest cell size of all the samples (i.e., the least chemical driving force into the emulsion), it gained 49 percent more water than D, apparently because of the poor transport resistance of the continuous phase containing the polar, non-ionic emulsifier.

EXAMPLE 2

Figure 2:
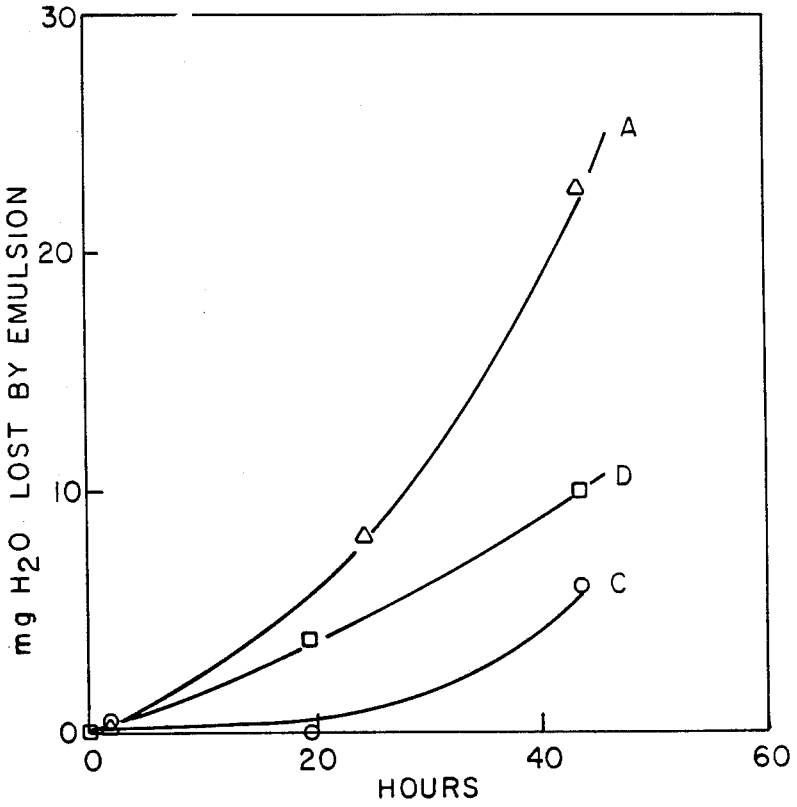
FIG. 2 is a plot of the rate at which water is transported into solid ammonium nitrate from an emulsion used in a product of the invention, as contrasted to an emulsion used in a product of the prior art.

The rate of transfer of water from samples of emulsion A, C, and D, described in Example 1, to ammonium nitrate pellets in surface contact therewith was measured as an estimate of the relative rates of transport of water from the emulsion's discontinuous aqueous phase to AN particles in emulsion/AN blends. In this experiment, in which the Water Diffusion Test described previously was performed, the emulsion samples of Example 1 were contacted on the surface with a cylindrical ammonium nitrate pellet of the same cross-sectional area. The water which diffused from the emulsion into the AN pellet is plotted against time in FIG. 2.

A comparison of samples C and D shows that the smaller cells of D increased the driving force for water transport from the emulsion, sample D, after 43 hours, having lost 66 percent more water than sample C. Moreover, water loss was much higher in A than in C or D (losing 283 percent more water than C or D after 43 hours) because of the combined hydrophilicity of the continuous emulsion phase and the higher driving force. A high degree of water absorption by the solid AN results in instability of the emulsion/AN blend.

EXAMPLE 3

An emulsion of the following formulation was made by the method described in Example 1 of U.S. Pat. No. 4,287,010:

| | % |
|---|---|
| Ammonium Nitrate (dissolved) | 60.8 |
| Sodium Nitrate (dissolved) | 13.5 |
| Water | 13.7 |
| Oil | 3.9 |
| Oleic Acid | 2.0 |
| Sodium Hydroxide | 0.5 |
| Fly Ash | 5.6 |

The percentages given by oleic acid and sodium hydroxide represent the proportions used to make sodium oleate in situ.

Two blends, A and B, were made with this emulsion:

| | Blend A | Blend B |
|---|---|---|
| Emulsion, % | 50 | 50 |
| ANFO (94% AN prills 6% No. 2 Fuel oil), % | 50 | — |
| ANWAX (94% AN prills 6% Paraffin wax), % | — | 50 |

A Differential Scanning Calorimeter (DSC) was used to determine the heat released on crystallization of the unblended emulsion, and of the emulsion component of each blend on cooling at 5° K./min. from 300° K. down to 220° K. These measurements were made when the samples were fresh and after 35 hours of storage at 49° C. Water transport from the emulsion causes concentration of salts in the dispersed aqueous phase and eventual crystallization of the cells. The relative degrees of crystallization present in each sample before cooling can be estimated by measuring the heat released on complete crystallization of the samples by DSC, higher heat release corresponding to less crystallization before cooling. The results were as follows:

| Heat Released on Total Crystallization (cal/g) | | |
|---|---|---|
| Hours at 49° C. | 0 | 35 |
| 100% Emulsion | 20.5 | 18.8 |
| Blend A | 15.4 | 8.8 |
| Blend B | 17.5 | 16.2 |

The above data show that Blend A (the blend with ANFO) was 53% more crystallized than the 100% emulsion sample after 35 hours at 49° C. On the other hand, Blend B (the blend with ANWAX) was only 14% more crystallized, and therefore more stable.

EXAMPLE 4

Emulsion/ANFO blends of various component ratios were prepared by mixing ANFO with an emulsion of the following formulation, prepared as described in Example 1 of U.S. Pat. No. 4,287,010:

| | |
|---|---|
| Ammonium Nitrate | 60.8 |

-continued

| | |
|---|---|
| (dissolved), % | |
| Sodium Nitrate (dissolved), % | 13.6 |
| Water, % | 13.56 |
| Oil, % | 3.84 |
| Oleic Acid, % | 1.96 |
| Sodium Hydroxide, % | 0.54 |
| Microspheres, % | 5.7 |

The stability of the blends after aging was determined by detonating them with or without confinement, and measuring their detonation velocities. The results are shown in the following table:

| Emulsion (%) | ANFO (%) | Age at (Days) | Temp. (°C.) | Vel. of Detonation in 12.7 cm diam. (m/sec) | Temp. (°C.) |
|---|---|---|---|---|---|
| 10 | 90 | 163 | 15 | 2670* | 20 |
| 20 | 80 | 76 | 15 | 4011* | 20 |
| 25 | 75 | 163 | 15 | 3250* | 20 |
| 30 | 70 | 163 | 15 | 3235* | 20 |
| 40 | 60 | 163 | 15 | 2375* | 20 |
| 50 | 50 | 132 | 15 | 3950* | 20 |
| 50 | 50 | 101 | −7 | 3890* | 5 |
| 59 | 41 | 40 | 15 | 2900** | 20 |
| 69 | 31 | 40 | 15 | 2900** | 20 |
| 79 | 21 | 40 | 15 | 4800** | 20 |
| 89 | 11 | 40 | 15 | 4800** | 20 |

*Confined in steel pipe
**Unconfined

EXAMPLE 5

The following "high oil" emulsions (22.5 kg mixes) were prepared in a 19-liter mixer by adding a 50% aqueous solution of sodium hydroxide to an aqueous solution of ammonium nitrate at 77° C., and adding the base-containing aqueous nitrate solution slowly with agitation to a 30° C. solution of oleic acid in a 3/1, by weight, mixture of No. 2 fuel oil and Gulf Endurance No. 9 oil. The agitator tip speed was 133 cm/sec during ingredient addition, and 400 cm/sec during a subsequent 5-minute shear cycle. The emulsions were then sheared further to reduce the cell size sufficiently to produce a viscosity comparable to that achievable by mixing at 600 cm/sec for an additional 2 minutes.

| | Emulsion No. | | | | |
|---|---|---|---|---|---|
| | A | B | C | D | E |
| Emulsion Composition (wt. %) | | | | | |
| AN | 71.4 | 70.0 | 68.2 | 65.3 | 60.7 |
| water | 19.8 | 19.4 | 18.9 | 18.1 | 16.8 |
| oil | 4.6 | 5.5 | 6.7 | 8.6 | 11.7 |
| oleic acid* | 2.7 | 3.3 | 4.0 | 5.1 | 7.0 |
| NaOH (50% aq. soln)* | 1.5 | 1.8 | 2.2 | 2.8 | 3.8 |
| Oxygen Balance | −9.3 | −14.4 | −20.9 | −31.2 | −48.2 |

*Weight added to form oleate emulsifier in situ.

Emulsions A through E (at ambient temperature) were mixed with AN prills to form blends A through E respectively. The mixing was carried out in a cement mixer at medium speed for 4 minutes.

| | Blend No. | | | | |
|---|---|---|---|---|---|
| | A | B | C | D | E |
| Blend Composition (wt. %) | | | | | |
| Emulsion | 70 | 60 | 50 | 40 | 30 |
| AN Prills | 30 | 40 | 50 | 60 | 70 |
| Oxygen Balance | −0.5 | −0.6 | −0.5 | −0.5 | −0.5 |
| Detonation Velocity (m/sec) | | | | | |
| in 12.7-cm-diam. steel | 3408 | — | 3401 | 4130 | 4188 |

A typical emulsion which would be blended in the same manner as emulsions A through E above is formulated from the following ingredients:

| | |
|---|---|
| oil | 6.7% |
| oleic acid | 1.3% |
| sodium oleate | 2.7% |
| Balance: | 80% aq. AN solution |

EXAMPLE 6

The importance of higher emulsifier levels in "high oil" emulsions was established by preparing the following emulsions in 700-gram quantities by the procedure described in Example 5 except that shearing at 400 cm/sec was performed for only 1 minute. When necessary, the duration of shearing was varied to give emulsion viscosities of 1000 poise. Emulsion stability was measured by centrifuging the emulsion for 10 minutes at 2500 rpm each day for 3 days, at ambient temperature, and determining the weight loss of the continuous (oil) phase.

| | Emulsion No. | | | | |
|---|---|---|---|---|---|
| | F | G | H | I | J* |
| Emulsion Composition (wt. %)** | | | | | |
| Oil | 7.4 | 7.4 | 6.7 | 6.7 | 8.4 |
| Oleic acid*** | 3.0 | 3.0 | 4.0 | 4.0 | 2.0 |
| NaOH (50% aq. soln.)*** | 1.65 | 3.3 | 2.2 | 4.4 | 1.1 |
| Oil/acid wt. ratio | 2.5 | 2.5 | 1.7 | 1.7 | 4.2 |
| Base/acid equiv. ratio | 1.5 | 3.0 | 1.5 | 3.0 | 1.5 |
| Wt. loss of oil phase (%) | 2 | 1 | 0 | 0 | 27 |

*Emulsion containing prior art emulsifier level
**Balance 80 weight-% AN solution
***Weight added to form oleate emulsifier in situ

EXAMPLE 7

The stability of the viscosity of blends of AN prills with the "high oil" emulsion of the invention, in contrast to blends made with "high oil" emulsions containing non-ionic emulsifying agents at sufficiently high levels to preserve emulsion stability was demonstrated by measuring the viscosities of six emulsion/prill blends containing 37.6 percent AN prills and 62.4 percent emulsion by weight. Three emulsions (K, L, and M) were according to the invention, and contained different amounts of emulsifying agent all of which were sufficient to produce a stable emulsion. Three emulsions (N, O, and P) were "high oil" control emulsions (i.e., they contained sufficient oil to oxygen-balance the blend with AN prills) that contained a non-ionic emulsifier in three different concentrations, only two of which (in emulsions O and P) were sufficient to prevent "creaming" of the oil phase.

In these emulsions the aqueous phase was a solution which consisted of 69.6% ammonium nitrate, 15.5% sodium nitrate (SN), and 14.9% water by weight. Emulsions K, L, and M were prepared according to the procedure described in Example 7 (with the exception that SN was included in the aqueous phase). Emulsions N, O, and P were prepared by adding sorbitan monooleate to the oil, and the AN/SN solution to the oil solution. Moreover, in the preparation of all six emulsions, extendospheres (fly ash) were added during the addition of the AN/SN solution to the oil. Emulsion viscosities were measured with a Brookfield viscometer at 29° C. using a 2 rpm Type E spindle.

The blends were made by mixing the emulsion and AN prills with low shear, by hand with a spatula.

Figure 3:
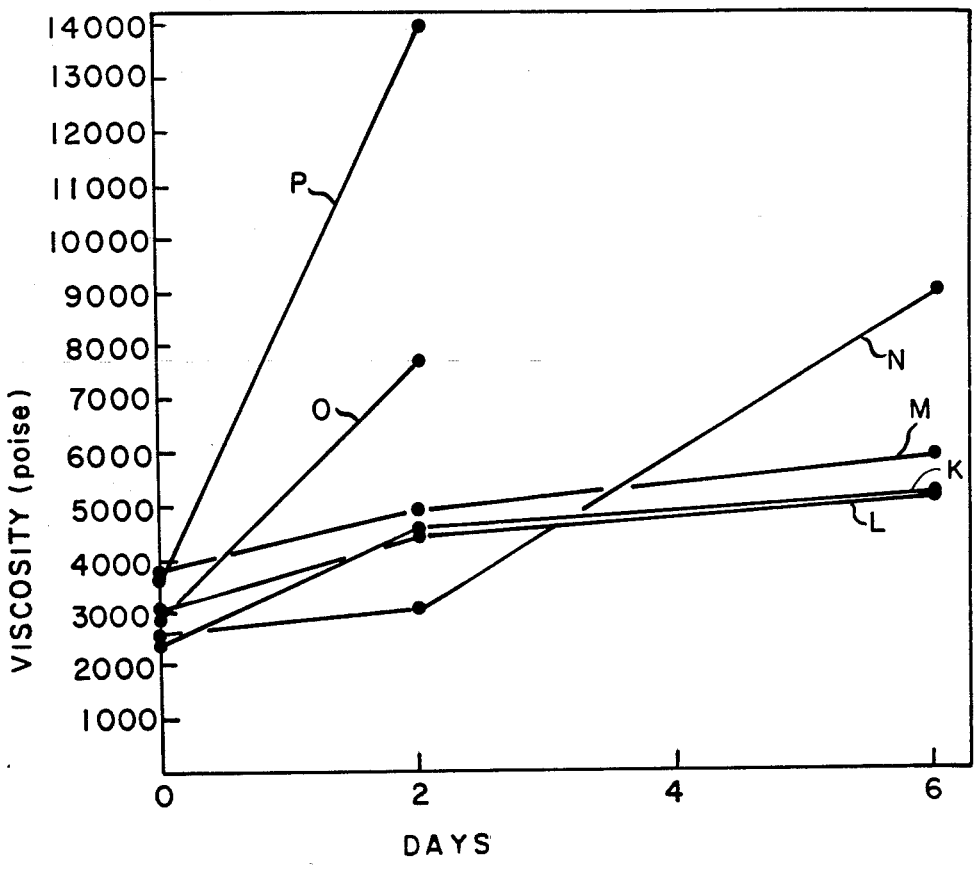
FIG. 3 is a plot of the viscosities of three blends of the invention and three control blends versus time.

The results are given in the following table, and plotted in FIG. 3.

| | Emulsion No. | | | | | |
|---|---|---|---|---|---|---|
| | K | L | M | N | O | P |
| Emulsion Composition (wt. %) | | | | | | |
| AN/SN Solution | 81.8 | 81.8 | 81.8 | 82.8 | 82.8 | 82.8 |
| Oil | 7.5 | 6.75 | 5.75 | 10.9 | 10.0 | 8.5 |
| Oleic acid* | 4.0 | 4.75 | 5.75 | | | |
| NaOH (50% aq. soln)* | 1.0 | 1.0 | 1.0 | | | |
| Sorbitan mono-oleate (SMO) | — | — | — | 0.6 | 1.5 | 3.0 |
| Extendospheres | 5.7 | 5.7 | 5.7 | 5.7 | 5.7 | 5.7 |
| Emulsion viscosity (poise) | 575 | 688 | 804 | 529 | 629 | 1000 |

*Weight added to form oleate emulsifier in situ.

Viscosities were measured (as described for the emulsion except at 25° C.) on the freshly made blends as well as on two- and six-day-old blends. Plots of viscosity vs. time for blends K through P are shown in FIG. 3. All blends had initial viscosities in the 2000–4000 poise range. However, while blends of the invention, i.e., blends K, L, and M, showed only a modest viscosity rise over a six-day period, reaching viscosities of only about 4500–5000 poise after six days, the control blends O and P showed a rapid rise within only two days. Control blend N, made from emulsion N, which contained an SMO concentration which was so low as to be insufficient to maintain emulsion stability, exhibited a low rate of viscosity rise over a two-day period, but rose rapidly in viscosity over the next four days. The extremely high viscosities of control blends O and P after two days rendered the blends essentially unpumpable (specifically, unable to flow by gravity from a tank to the suction of a pump), and indicated a deleterious change in the emulsion structure (crystallization in the aqueous phase) which characteristically compromises the blend's ability to detonate. Conversely, blends K, L, and M showed no visual evidence of crystallization and were suitable for pumping.

EXAMPLE 8

The following experiment shows that even stable emulsion/ANFO blends having minimized water transport according to the method of the invention can be improved by the use of the high-oil high-emulsifier emulsion of the invention. Three emulsions, Q, R, and S, were prepared as described in Example 5 for the preparation of emulsions A through E (except that sodium nitrate was included in the aqueous phase in emulsions Q and R, and extendospheres were added in all three, as in Example 7). Emulsions R and S were the preferred "high oil" emulsions, and emulsion Q was an oxygen-balance emulsion having a lower oil content and emulsifier content than emulsions R and S. Blends R and S were 50/50 emulsion/AN prills. Emulsion Q was blended in the same ratio with ANFO prills, i.e., AN prills lightly coated with fuel oil in a 94/6 AN/oil weight ratio. Blending was carried out in a cement mixer as described in Example 5. The results were as follows:

| | Emulsion No. | | |
|---|---|---|---|
| | Q | R | S |
| Emulsion Composition (wt. %) | | | |
| AN | 60.8 | 55.7 | 67.45 |
| SN | 13.6 | 12.5 | — |
| water | 13.0 | 11.9 | 14.8 |
| oil | 3.85 | 8.0 | 7.5 |
| oleic acid* | 1.95 | 4.0 | 3.0 |
| NaOH (50% aq. soln.)* | 1.1 | 2.2 | 1.65 |
| Extendospheres | 5.7 | 5.7 | 5.7 |

*Weight added to form oleate emulsifier in situ.

| | Blend No. | | |
|---|---|---|---|
| | Q | R | S |
| Blend Age | Detonation Velocity | | |
| 13 days | 3,097 | 3,097 | 3,690 |
| 39 days* | 1,618 | 3,306 | 3,284 |

*60 days for Blend S

The detonation velocities (m/sec) were measured on 12.7-cm diameter, unconfined samples initiated with a 0.45-kg booster. Although blend Q is comparable to blends R and S at age 39 days in terms of confined detonation velocity, blends R and S do not require confinement at this age (nor does blend S require it at age 60 days) to detonate at acceptable velocities.

EXAMPLE 9

The blends described in Examples 5 and 6 were made with "high oil" emulsions containing no physical sensitizers such as fly ash, glass microballoons, etc. The void or gas volume needed to sensitize these blends was provided by the AN prills used. Five additional blends were made with an emulsion containing no such physical sensitizers, the emulsion used in these blends being a "low oil" (oxygen-balance) emulsion made by the method described in Example 1 of U.S. Pat. No. 4,287,010, except that the sodium nitrate and microspheres were omitted. Its formulation was as follows:

| | % |
|---|---|
| Ammonium nitrate (dissolved) | 75.6 |
| Water | 17.2 |
| Oil | 4.3 |
| Oleic acid* | 2.1 |
| NaOH (50% aq. soln.)* | 0.6 |

*Weight added to form oleate emulsifier in situ

This emulsion (at ambient temperature) was mixed with ANFO prills to form blends T, U, V, W, and X. The mixing was carried out in a cement mixer at medium speed for 4 minutes.

| | Blend No. | | | | |
|---|---|---|---|---|---|
| | T | U | V | W | X |
| Blend Composition (wt. %) | | | | | |
| Emulsion | 80 | 70 | 60 | 50 | 30 |
| ANFO Prills | 20 | 30 | 40 | 50 | 70 |
| Detonation Velocity (m/sec)* | | | | | |
| in 12.7-cm-diam. steel pipe | 3409 | 4646 | 2843 | 3432 | 3810 |

*Blends T, U tested 2 days after blending
Blend V tested 17 days after blending
Blend W tested 19 days after blending
Blend X tested 20 days after blending

EXAMPLE 10

A "high oil" emulsion of the following formulation was prepared as described in Example 5:

| | % |
|---|---|
| Ammonium nitrate (dissolved) | 70.9 |
| Water | 16.6 |
| Oil | 7.6 |
| Oleic acid* | 3.8 |
| NaOH (50% aq. soln.)* | 1.1 |

*Weight added to form oleate emulsifier in situ

The emulsion was blended with sodium nitrate (SN) particles and oil in a weight ratio of 50/46.5/3.5 parts emulsion/SN/oil. This blend detonated after 14 days at a velocity of 4354 m/sec.

EXAMPLE 11

The emulsion described in Example 4 was blended with sodium nitrate particles and oil in various weight ratios, packaged in 12.7-cm diameters, and detonated in 12.7-cm steel pipes with a 0.45-kg primer. The results were as follows:

| % Emulsion | % SN | % Oil | Detonation Velocity (m/sec) |
|---|---|---|---|
| 88.7 | 10 | 1.3 | 4000 (after 70 days) |
| 76.0 | 20 | 4.0 | 4884 (after 70 days) |
| 64.3 | 30 | 5.7 | 3097 (after 70 days) |
| 52.2 | 40 | 7.8 | 2965 (after 5 days) |

What is claimed is:

1. In a method of preparing an explosive composition by combining inorganic nitrate particles with a water-in-oil emulsion comprising (a) a liquid carbonaceous fuel having components which form a continuous emulsion phase, (b) an aqueous solution of an inorganic oxidizing salt forming a discontinuous emulsion phase dispersed at discrete droplets within said continuous phase, and (c) an emulsifying agent to form a blend of said particles and said emulsion containing a sensitizing amount of dispersed gas bubbles or voids, the improvement comprising forming said inorganic nitrate particles and the components of said emulsion into a structure that minimizes the loss of water from said droplets and transportation thereof across said continuous oil phase to said nitrate particles.

2. A method of claim 1 wherein said structure is formed by combining said inorganic nitrate particles with an emulsion which contains, in its emulsifying system, a salt of a fatty acid, as well as the free fatty acid in solution in an oil, said oil solution forming said continuous emulsion phase, and said fatty acid, said fatty acid salt, and said oil together forming said liquid carbonaceous fuel.

3. A method of claim 2 wherein the inorganic nitrate particles combined with said emulsion to form said blend are air-carrying prills, and the emulsion combined with said prills is devoid of a sensitizing amount of dispersed gas bubbles or voids.

4. A method of claim 3 wherein the prills used to form said blend are ANFO prills, and the emulsion used is essentially oxygen-balanced.

5. A method of claim 1 wherein said structure is formed by mixing said particles with an emulsion which has been formed by mixing said liquid carbonaceous fuel and said aqueous salt solution at a rate and for a time sufficient to produce a cell size of said discontinuous emulsion phase in the range of about from 1 to 4 microns.

6. A method of claim 1 wherein said structure is formed by coating said particles with an agent in which water has a diffusion coefficient at 25° C. of less than about $10^{-5}$ $cm^2$/sec.

7. A method of claim 1 wherein said inorganic nitrate particles are AN prills, ANFO prills, or a combination thereof.

8. A method of claim 1 wherein said blend is formed and thereafter packaged.

9. A method of claim 8 wherein said emulsion, when aged at 25° C. for 2 days, loses no more than about 4 percent of its original weight when subjected to the following Water Diffusion Test: filling a cylindrical pan of 7.5 mm radius and 2.6 mm height with 0.325 cc of freshly prepared emulsion, contacting the emulsion's flat exposed surface of 1.25 $cm^2$ area with a cylindrical pellet of an inorganic nitrate having the same cross-sectional area as the emulsion sample and a height of at least 1 cm, and storing the emulsion/nitrate sample for 48 hours in dry air at 25° C., after which time the emulsion is analyzed for water loss.

10. A method of claim 8 wherein said structure is formed by combining said nitrate particles with an emulsion which contains, in its emulsifying system, a salt of a fatty acid, as well as the free fatty acid in solution in an oil, said oil solution forming said continuous emulsion phase, and said fatty acid, said fatty acid salt, and said oil together forming said liquid carbonaceous fuel.

11. A method of claim 10 wherein said fatty acid is selected from the group consisting of saturated and mono-, di-, and tri-unsaturated monocarboxylic acids containing about from 12 to 22 carbon atoms, and said salt is an alkali metal, ammonium, and/or alkylammonium salt.

12. A method of claim 10 wherein said structure is formed by combining said nitrate particles with an emulsion that has been obtained by combining said oil and said aqueous solution with agitation in the presence of said fatty acid and a base so as to form said fatty acid salt emulsifying agent in situ.

13. A method of claim 8 wherein said structure is formed by mixing said particles with an emulsion which has been formed by mixing said liquid carbonaceous fuel and said aqueous salt solution at a rate and for a time sufficient to produce a cell size of said discontinuous emulsion phase in the range of about from 1 to 4 microns.

14. A method of claim 8 wherein said structure is formed by coating said particles with an agent in which water has a diffusion coefficient at 25° C. of less than about $10^{-5}$ $cm^2$/sec.

15. A method of claim 10 wherein said particles constitute at least about 20 percent, and said emulsion constitutes at least about 20 percent, by weight of said blend.

16. A method of claim 10 wherein said inorganic nitrate particles are AN prills, ANFO prills, or a combination thereof.

17. In a method of preparing an explosive composition by combining inorganic nitrate particles with a water-in-oil emulsion comprising (a) a liquid carbonaceous fuel having components which form a continuous emulsion phase, (b) an aqueous solution of an inorganic oxidizing salt forming a discontinuous emulsion phase dispersed as discrete droplets within said continuous phase, and (c) an emulsifying agent to form a blend of said particles and said emulsion containing a sensitizing amount of dispersed gas bubbles or voids, the improvement comprising combining inorganic nitrate prills with an emulsion which contains liquid carbonaceous fuel in an amount sufficient to essentially oxygen-balance said prills and said inorganic oxidizing salt present in said aqueous solution, said emulsion containing, in its emulsifying system, a salt of a fatty acid, as well as the free fatty acid in solution in an oil, said oil solution forming said continuous emulsion phase, and said fatty acid, said fatty acid salt, and said oil together forming said liquid carbonaceous fuel.

18. A method of claim 17 wherein said fatty acid is selected from the group consisting of saturated and mono-, di-, and tri-unsaturated monocarboxylic acids containing about from 12 to 22 carbon atoms, and said salt is an alkali metal, ammonium, and/or alkylammonium salt.

19. A method of claim 18 wherein said structure is formed by combining said nitrate prills with an emulsion that has been obtained by combining said oil and said aqueous solution with agitation in the presence of a fatty acid and a base so as to form a fatty acid salt emulsifying agent in situ.

20. A method of claim 19 wherein the amount of liquid carbonaceous fuel in said emulsion is about from 7 to 21 percent, based on the weight of said emulsion.

21. A method of claim 20 wherein the amounts of fatty acid and base added to form said fatty acid salt in situ are sufficient that the ratio of the amount of oil added to the amount of fatty acid added is in the range of about from 1/1 to 3/1 by weight, and the equivalents ratio of the amount of base added to the amount of fatty acid added is in the range of about from 0.5/1 to 3/1.

22. A method of claim 21 wherein said fatty acid is oleic acid, and said fatty acid salt is ammonium oleate and/or one or more alkali metal salts of oleic acid.

23. A method of claim 17 wherein said blend is formed from an emulsion that is devoid of a sensitizing amount of dispersed gas bubbles or voids.

24. A method of claim 17 wherein supplemental air-carrying solid materials are combined with said prills and emulsion.

25. A method of claim 17 wherein said prills are AN prills.

26. A method of claim 25 wherein said AN prills constitute about from 20 to 70 percent by weight of said blend.

27. A water-in-oil emulsion adapted to be blended with inorganic nitrate prills to form an explosive, said emulsion comprising (a) about from 7 to 21 percent by weight of a liquid carbonaceous fuel including an oil solution of a fatty acid, said solution forming a continuous emulsion phase;

(b) an aqueous solution of an inorganic oxidizing salt forming a discontinuous emulsion phase dispersed as discrete droplets within said continuous phase; and (c) an emulsifying system comprising (1) said fatty acid and (2) a fatty acid salt, said oil, fatty acid, and fatty acid salt together forming said liquid carbonaceous fuel, and the ratio of the amounts of oil and fatty acid added to form said emulsion being in the range of about from 1/1 to 3/1 by weight; said emulsion having an oxygen balance more negative than about −6 percent.

28. An emulsion of claim 27 wherein said emulsifying system is one which forms in situ from a fatty acid and a base as said oil and said aqueous solution are brought together to form said emulsion, the ratio of the amount of base added to the amount of fatty acid added to form said emulsifying system being about from 0.5/1 to 3/1 by weight.

29. An emulsion of claim 28 having a viscosity in the range of about from 500 to 10,000 poise, and stable in emulsion structure for a period of at least about 3 months.

30. An emulsion of claim 27 wherein said emulsifying system is formed by adding a fatty acid and a salt of a fatty acid to the other components of the emulsion, said ratio of oil to "fatty acid" being understood to be the ratio of oil to fatty acid plus fatty acid salt added when the emulsion is being made, and the ratio of said fatty acid salt added to fatty acid added being at least about 0.5/1.

31. An emulsion of claim 27 wherein said fatty acid salt is selected from alkali metal, ammonium, and alkylammonium salts of saturated and mono-, di-, and tri-unsaturated monocarboxylic acids containing about from 13 to 22 carbon atoms.

32. An emulsion of claim 31 wherein said fatty acid is oleic acid, and said fatty acid salt is ammonium oleate and/or one or more alkali metal salts of oleic acid.

33. An emulsion of claim 27 containing dispersed air-carrying inert solid materials.

34. An emulsion of claim 27 devoid of a sensitizing amount of dispersed gas bubbles or voids.

35. An essentially oxygen-balanced water-in-oil emulsion adapted to be blended with inorganic nitrate prills and oil to form an explosive, said emulsion comprising (a) a liquid carbonaceous fuel including an oil solution of a fatty acid, said solution forming a continuous emulsion phase;

(b) an aqueous solution of an inorganic oxidizing salt forming a discontinuous emulsion phase dispersed as discrete droplets within said continuous phase; and (c) an emulsifying system comprising (1) said fatty acid and (2) a fatty acid salt, said oil, fatty acid, and fatty acid salt together forming said liquid carbonaceous fuel;

said emulsion being devoid of a sensitizing amount of dispersed gas bubbles or voids.

36. An emulsion of claim 35 wherein said prills and oil with which said emulsion is adapted to be blended are AN prills mixed with fuel oil.

37. An explosive product comprising a blend of about from 30 to 80 percent by weight of the emulsion of claim 27 and about from 70 to 20 percent by weight of inorganic nitrate prills sufficient to essentially oxygen balance said emulsion, said blend containing a sensitizing amount of dispersed gas bubbles or voids.

38. An explosive product comprising a blend of about from 50 to 80 percent by weight of the emulsion of claim 28 and about from 50 to 20 percent by weight of ammonium nitrate prills sufficient to essentially oxygen balance said emulsion, said blend containing a sensitizing amount of dispersed gas bubbles or voids, having a viscosity in the range of about from 2500 to 20,000 poise, and remaining in said range for a period of several days.

39. An explosive product of claim 37 wherein said dispersed gas is the gas present in said ammonium nitrate prills.

40. An explosive product of claim 37 wherein supplemental air-carrying solid materials are present.

41. An explosive product of claim 37 wherein the prill content is about from 40 to 60 percent by weight, and the liquid carbonaceous fuel content of said emulsion is about from 9 to 15 percent by weight.

42. A method of delivering the explosive product of claim 38 to a borehole through a conduit comprising pumping said product to the borehole through an annular stream of aqueous lubricating liquid flowing through the conduit in the same direction as the explosive product, said product being adapted to resume flowing when pumping is resumed after extended periods of rest in said conduit, independently of the composition of said aqueous lubricating liquid.

43. A method of claim 42 wherein said aqueous lubricating liquid is naturally occurring water.

44. An aged, storage-stable explosive product comprising, in a package, a blend of particles of ammonium nitrate (AN) and an emulsion comprising (a) a liquid carbonaceous fuel including an oil solution of a fatty acid, said solution forming a continuous emulsion phase, (b) an aqueous solution of an inorganic oxidizing salt forming a discontinuous emulsion phase dispersed as discrete droplets within the continuous phase, and (c) an emulsifying system including an emulsifying agent comprising (1) an alkali metal, ammonium, or alkylammonium salt of a fatty acid containing about from 12 to 22 carbon atoms, as well as (2) the free fatty acid, said fatty acid, said fatty acid salt, and said oil together forming said liquid carbonaceous fuel, and said blend containing dispersed gas bubbles or voids comprising at least about 5 percent of its volume, said emulsion, when aged at 25° C. for 2 days, losing no more than about 4 percent of its original weight when subjected to the following Water Diffusion Test: filling a cylindrical pan of 7.5 mm radius and 2.6 mm height with 0.325 cc of freshly prepared emulsion, contacting the emulsion's flat exposed surface of 1.25 $cm^2$ area with a cylindrical pellet of ammonium nitrate having the same cross-sectional area as the emulsion sample and a height of at least 1 cm, and storing the emulsion/AN sample for 48 hours in dry air at 25° C., after which time the emulsion is analyzed for water loss.

45. An explosive product of claim 44 wherein said emulsion has been obtained by combining said aqueous solution and an oil with agitation in the presence of a fatty acid and a base so as to form said fatty acid salt in situ, said emulsifying system also containing base.

46. An explosive product of claim 45 wherein said AN particles constitute at least about 20 percent, and said emulsion constitutes at least about 20 percent, of said blend by weight.

47. An explosive product comprising a blend of inorganic nitrate prills and an emulsion comprising (a) a liquid carbonaceous fuel having components which form a continuous emulsion phase, (b) an aqueous solution of an inorganic oxidizing salt forming a discontinuous emulsion phase dispersed as discrete droplets within the continuous phase, and (c) an emulsifying system including an emulsifying agent comprising a salt of a fatty acid, as well as the free fatty acid in solution in an oil, said oil solution forming said continuous emulsion phase, and said fatty acid, said fatty acid salt, and said oil together forming said liquid carbonaceous fuel, said blend containing a sensitizing amount of dispersed gas essentially provided by said prills.

48. An explosive product of claim 47 wherein said prills are AN prills which constitute about from 20 to 80 percent by weight of said blend.

49. An explosive product of claim 48 wherein the ammonium nitrate prills used to form the blend are ANFO prills, and the emulsion used is an essentially oxygen-balanced emulsion.

50. A method of claim 1 wherein a substantially hydrophobic medium is present between said inorganic nitrate particles and the aqueous droplets in said emulsion.

51. A method of claim 1 wherein said emulsion, when aged at 25° C. for 2 days, loses no more than about 4 percent of its original weight when subjected to the following Water Diffusion Test: filling a cylindrical pan of 7.5 mm radius and 2.6 mm height with 0.325 cc of freshly prepared emulsion, contacting the emulsion's flat exposed surface of 1.25 $cm^2$ area with a cylindrical pellet of an inorganic nitrate having the same cross-sectional area as the emulsion sample and a height of at least 1 cm, and storing the emulsion/nitrate sample for 48 hours in dry air at 25° C., after which time the emulsion is analyzed for water loss.

52. A method of claim 1 wherein said emulsion constitutes about from 10 to 90 percent, and said particles about from 90 to 10 percent, by weight of said blend.

53. A method of claim 9 wherein said emulsion constitutes about from 10 to 90 percent, and said particles about from 90 to 10 percent, by weight of said blend.

54. A method of claim 17 wherein said emulsion constitutes about from 10 to 90 percent, and said prills about from 90 to 10 percent, by weight of said blend.

55. A method of claim 51 wherein said emulsion constitutes about from 10 to 90 percent, and said particles about from 90 to 10 percent, by weight of said blend.

56. An explosive product of claim 44 wherein said emulsion constitutes about from 10 to 90 percent, and said particles about from 90 to 10 percent, by weight of said blend.

* * * * *